US006129178A

United States Patent [19]

Shupp, Jr.

[11] Patent Number: 6,129,178

[45] Date of Patent: Oct. 10, 2000

[54] ESCAPE LADDER AND HOUSING ASSEMBLY

[76] Inventor: Ronald J. Shupp, Jr., 9208 Charlton Pl., Douglasville, Ga. 30135

[21] Appl. No.: 09/314,517

[22] Filed: May 19, 1999

[51] Int. Cl.[7] ..... A62B 1/06

[52] U.S. Cl. ..... 182/76; 182/70

[58] Field of Search ..... 182/70, 76, 74, 182/73, 196; 248/201, 209, 300

[56] References Cited

U.S. PATENT DOCUMENTS

| | | | |
|---|---|---|---|
| 2,946,398 | 7/1960 | Mc Nulty | 182/196 |
| 2,990,908 | 7/1961 | Wozniak | 182/70 |
| 3,809,181 | 5/1974 | Staranick et al. | 182/70 |
| 4,381,046 | 4/1983 | Landem | 182/70 |
| 5,467,841 | 11/1995 | Krumal | 182/70 |
| 5,746,287 | 5/1998 | Durham, Jr. | 182/70 |
| 5,842,539 | 12/1998 | Hough | 182/70 |

*Primary Examiner*—Daniel P. Stodola
*Assistant Examiner*—Hugh B. Thompson
*Attorney, Agent, or Firm*—B. J. Powell

[57] ABSTRACT

An escape ladder and housing assembly adapted to be attached to the framework in the wall of a structure below an escape opening comprising a housing, a ladder construction adapted to be stowed within the housing, and a connection assembly mounted in the housing connected to the ladder construction so that, when the ladder construction is deployed through the escape opening, loads on the ladder are transmitted to the housing and the wall framework.

15 Claims, 4 Drawing Sheets

ESCAPE LADDER AND HOUSING ASSEMBLY

BACKGROUND OF THE INVENTION

This invention relates generally to escape ladders and more particularly to escape ladders and housing assemblies for multi-story buildings fitted into a housing adapted to be mounted on the interior of a building under a window.

Various constructions have been proposed for escape ladders for buildings that can be deployed for use. One type of such escape ladders uses a ladder comprising a pair of flexible side members with a plurality of step members extending between the flexible side members at spaced apart intervals. Various flexible side members have been used such as cables or chains. The following prior art patents are exemplary of the various constructions proposed in the past:

| U.S. Pat. No. | Inventor | Issue Date |
|---|---|---|
| 3900081 | F. Dunston | 8/1975 |
| 3946833 | J. Riehlmann | 3/1976 |
| 3997026 | J. Riehlmann | 12/1976 |
| 4127184 | R. Strohmeyer | 11/11978 |
| 4164991 | A. Marra | 8/1979 |
| 4245717 | D. Soucy | 1/1981 |
| 4381046 | R. Landem | 4/1983 |
| 4401183 | E. Schler | 8/1983 |
| 4445589 | B. Longenecker | 5/1984 |
| 4476957 | H. Ory | 10/1984 |
| 4531612 | J. Sandor | 7/1985 |
| 4702347 | A. Nilsen | 10/1987 |
| 4951779 | C. Tseng | 8/1990 |
| 5022491 | J. Gill | 6/1991 |
| 5311965 | H. Wu | 5/1994 |
| 5339920 | G. Eriksson | 8/1994 |
| 5377778 | T. Lan | 1/1995 |

These prior art fire escape ladders are relatively complicated and therefore difficult and cumbersome to use. Moreover, many of these prior art fire escape ladders are not permanently attached to the building structure thereby increasing the likelihood of dislodgement during use. On those prior art escape ladders that are attached to the building structure, the interconnection is such that high load stress points are created that contribute to failure when the ladder is loaded.

SUMMARY OF THE INVENTION

These and other problems and disadvantages associated with the prior art are overcome by the invention disclosed herein by providing an escape ladder and housing assembly which permits the escape ladder to be easily and quickly deployed, which is attached directly to the framework within the wall of a structure, and which transmits the ladder load directly to the structure framework.

The apparatus of the invention is incorporated in an escape ladder and housing assembly adapted to be attached to the framework in the wall of a structure below an escape opening comprising a housing including a pair of upright side walls adapted to be attached to the framework in the wall of the structure below the escape opening, and a generally horizontal bottom wall connected to the side walls so that loads imposed on the bottom wall are transmitted to the side walls, the bottom wall including an inverted U-shaped section therein;

a ladder construction including a pair of flexible ladder side members having first and second opposed ends, and a plurality of rung members mounted on the flexible side members at spaced apart positions so that the ladder construction has a collapsed condition for stowing and a deployed condition for use; and, a connection assembly mounted in the inverted U-shaped section of the bottom wall and connected to the first ends of the flexible side members to connect the ladder construction to the housing so that, when the ladder construction is deployed through the escape opening, loads on the ladder are transmitted to the housing and the wall framework through the inverted U-shaped section in the bottom wall. The housing may further comprise a back wall extending between the housing side walls to define a ladder receiving chamber therein sized to stow the ladder construction therein in a collapsed condition, the ladder receiving chamber defining a front opening thereto opposite the back wall so that the ladder construction can be deployed therethrough, and the inverted U-shaped section located in the bottom of the ladder receiving chamber so that the ladder construction can be completely stowed within the chamber. Also, the housing may further include a door operatively associated with the housing side walls to selectively close the front opening of the housing so as to enclose the ladder construction within the chamber when the door is closed. A flexible member may extend between the side walls to hold the ladder construction in place within the chamber, the flexible member including a lower edge mounted between the side walls adjacent the bottom wall and an opposed upper edge; and releasable catch means for releasably interconnected the upper edge of the flexible member to the housing to selectively retain the ladder construction within the chamber in a stowed condition. The connection assembly may further comprise an interconnect member having a cross-sectional size and shape to fit within the inverted U-shaped section in the bottom wall, and wherein the inverted U-shaped sections define a pair of spaced apart cutouts therein, the first ends of the flexible side members of the ladder construction attached to the interconnect member and extend through the cutouts in the inverted U-shaped member so that forces exerted on the ladder construction when deployed force the interconnect member against the inverted U-shaped section of the bottom wall. The first ends of the flexible ladder side members may include a loop defining an attachment opening therethrough, and the interconnect member may define a pair of spaced apart loop receiving slots therethrough located so as to be in registration with the cutouts in the inverted U-shaped section when the interconnect member is located within the inverted U-shaped section of the bottom wall, and the connection assembly may further comprises fastener means attaching the loops in the first ends of the flexible side members of the ladder construction in the loop receiving slots through the interconnect member. The housing may further include adjustment means for accommodating different spacing within the framework within the wall of the structure to mount the housing on the framework. The adjustment means may comprise a plurality of mounting holes through each of the side walls of the housing; a pair of adjustment plates, one associated with each of the side walls; a plurality of elongate adjustment spacers mounted on each of the adjustment plates at locations conforming to the locations of the mounting holes in the side walls and projecting outwardly therefrom generally normal thereto so that the adjustment spacers slidably pass through the mounting holes in the side walls with the adjustment plate located within the chamber in the housing, the adjustment spacers defining fastener receiving holes therethrough; and a plurality of mounting fasteners adapted to extend through the adjustment spacers into the wall framework to attach the housing to the framework.

These and other features and advantages of the invention will become more clearly understood upon consideration of the following detailed description and accompanying drawings wherein like characters of reference designate corresponding parts throughout the several views and in which:

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

Figure 1:
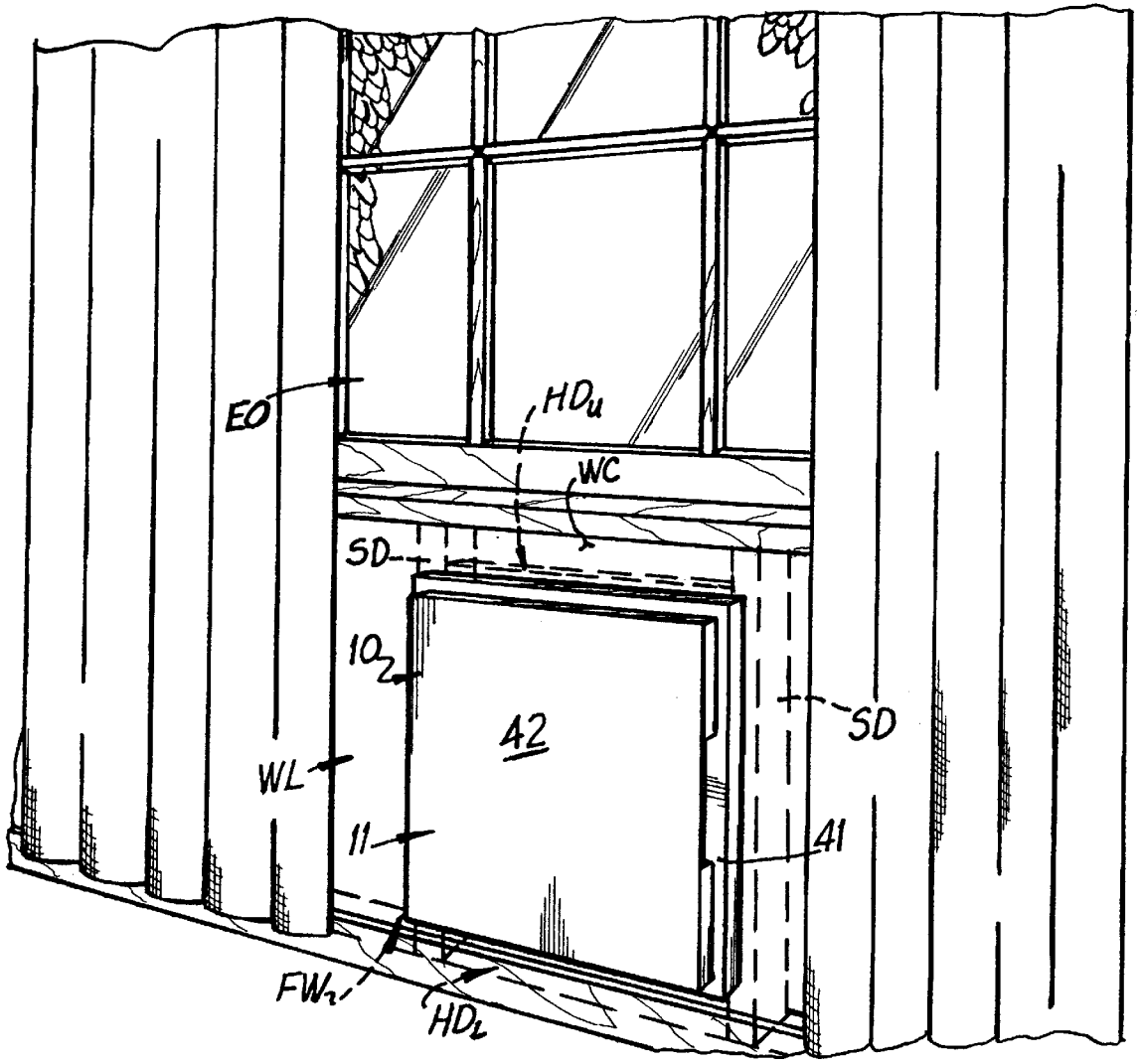
FIG. 1 is a perspective view of an escape ladder and housing assembly incorporating my invention.

Referring to the drawings, it will be seen that the invention is directed to an escape ladder and housing assembly 10 adapted to be attached to the framework FW in the wall WL of a structure below an escape opening EO such as a window as best seen in FIG. 1. The assembly 10 comprises generally a housing 11 adapted to fit in the wall WL in which is mounted a collapsible ladder construction 12 through a connection assembly 14. The ladder construction 11 is deployed out through the escape opening EO and remains permanently attached to the housing 11 to facilitate rapid deployment of the ladder construction 12. Because the housing 11 is attached directly to the wall framework FW, loads on the ladder construction 12 are transferred directly to the wall framework FW to maximize safety.

The walls WL are of typical construction with spaced apart vertically extending studs SD on conventional spacing, usually 16 inch centers. On pre-existing walls WL, a hole is cut in the wall covering WC such as sheetrock to provide access to the studs SD. Preferably, upper and lower headers $HD_U$ and $HD_L$ are installed between the studs SD at vertical spacing corresponding to the height of the housing 11. The housing 11 is then installed between the studs SD and headers $HD_U$ and $HD_L$ as will become more apparent.

The housing 11 seen in FIGS. 2, 4, and 5 includes a pair of upright side walls 21 adapted to be attached to the framework FW in the wall WL of the structure below the escape opening EO, a generally horizontal bottom wall 22 connected to the side walls 21so that loads imposed on the bottom wall 22 are transmitted to the side walls, a generally horizontal top wall 24 connected between the side walls 21 and spaced above the bottom wall 22, and a back wall 25 integral with the back edges of the top and bottom walls 24 and 22 respectively and connected to the side walls 21. A ladder receiving chamber 26 seen in FIGS. 2–5 is defined in the housing 11 with a front opening 28 through which the ladder construction 12 is deployed.

Figure 2:
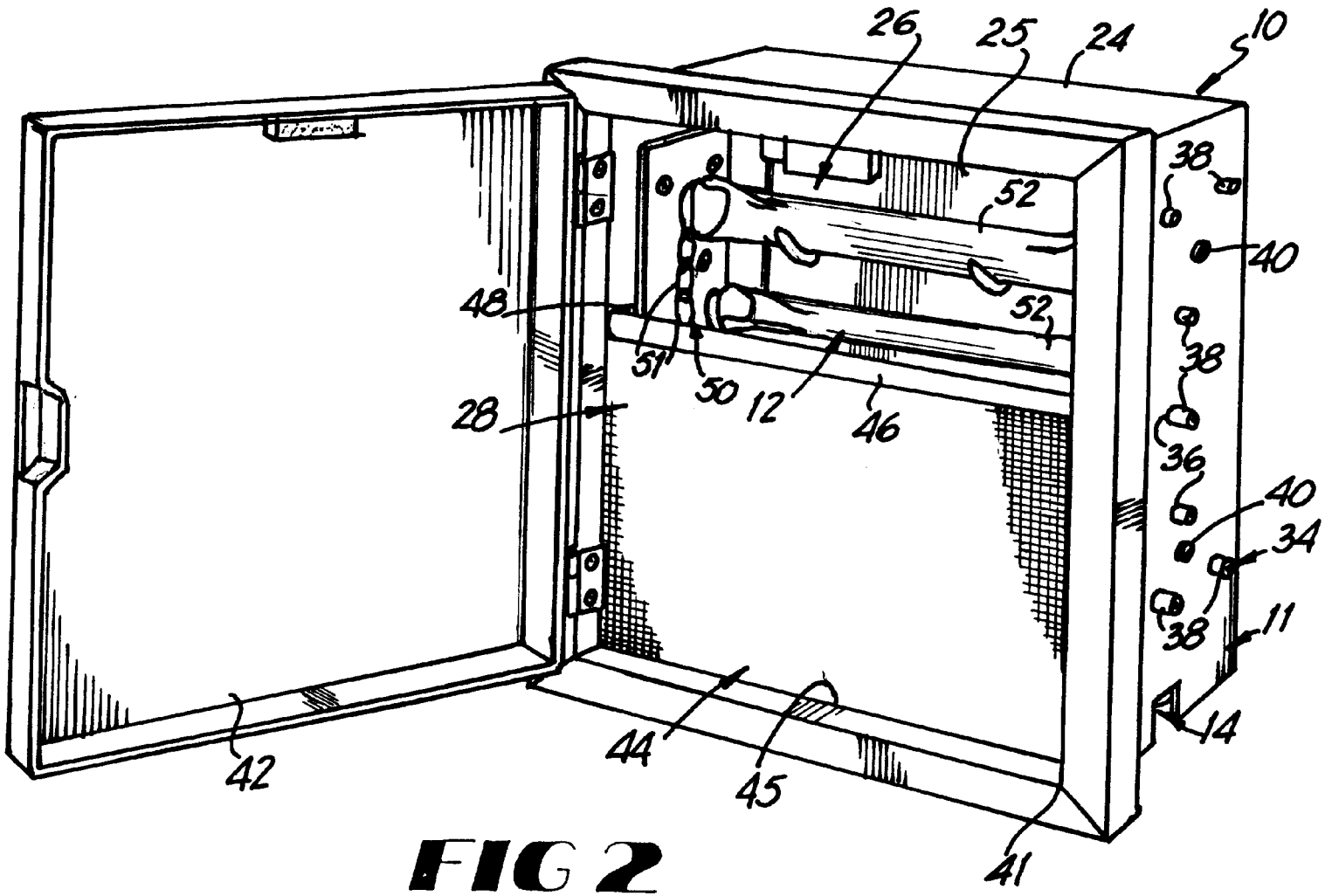
FIG. 2 is a perspective view of the assembly of FIG. 1 in an open position.
Figure 3:
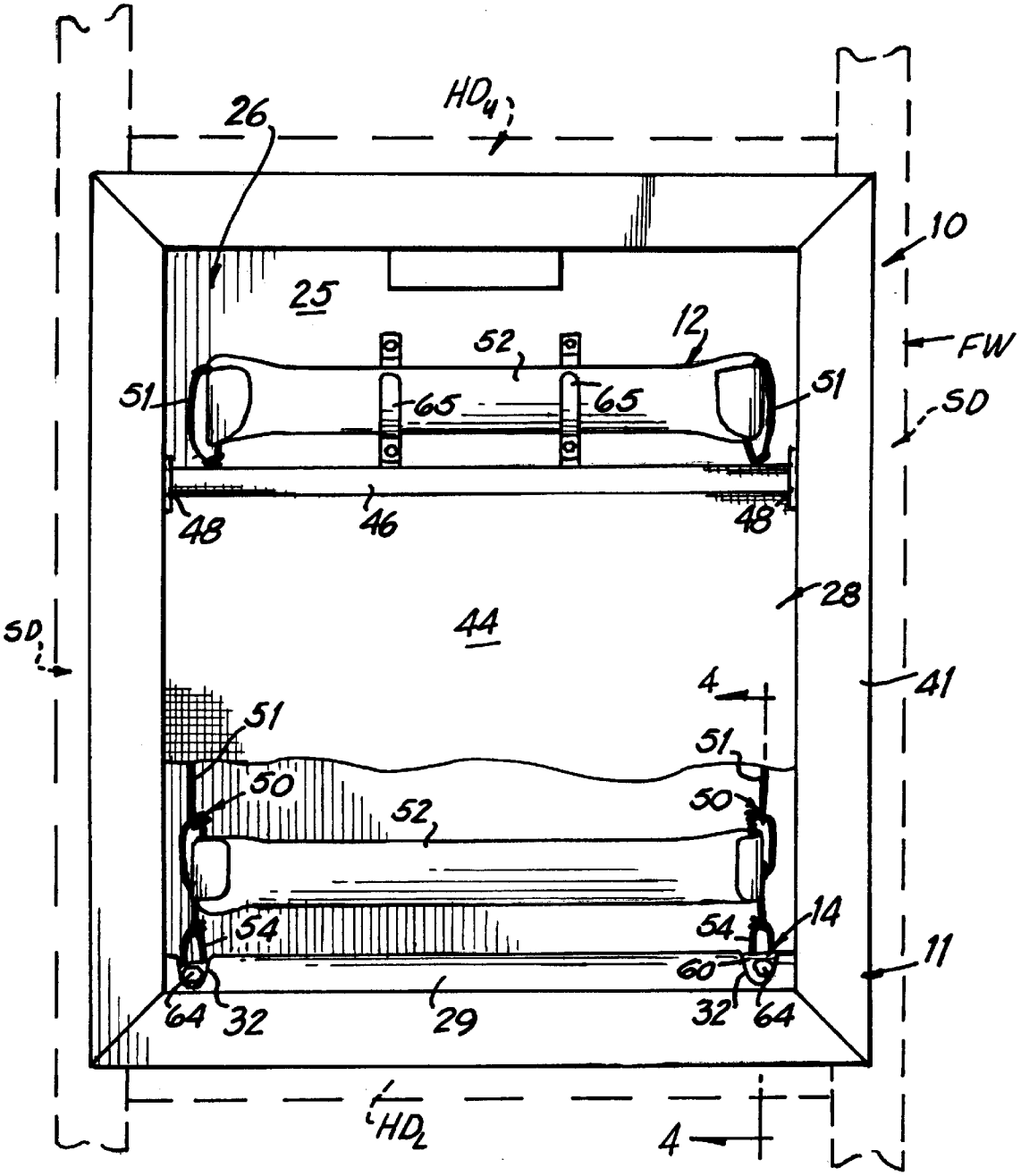
FIG. 3 is an enlarged front view of the invention.
Figure 4:
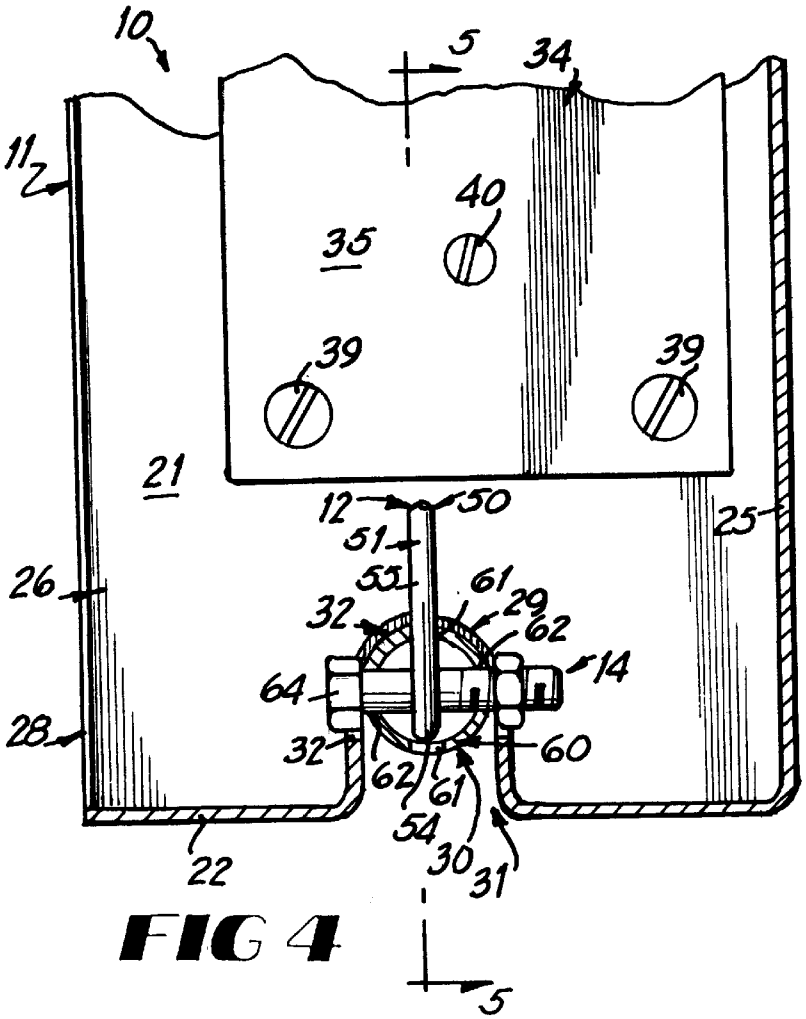
FIG. 4 is an enlarged vertical cross-sectional view taken generally along line 4—4 in FIGS. 3 and 5; and, FIG. 5 is an enlarged cross-sectional view taken generally along line 5—5 in FIG. 4.
Figure 5:
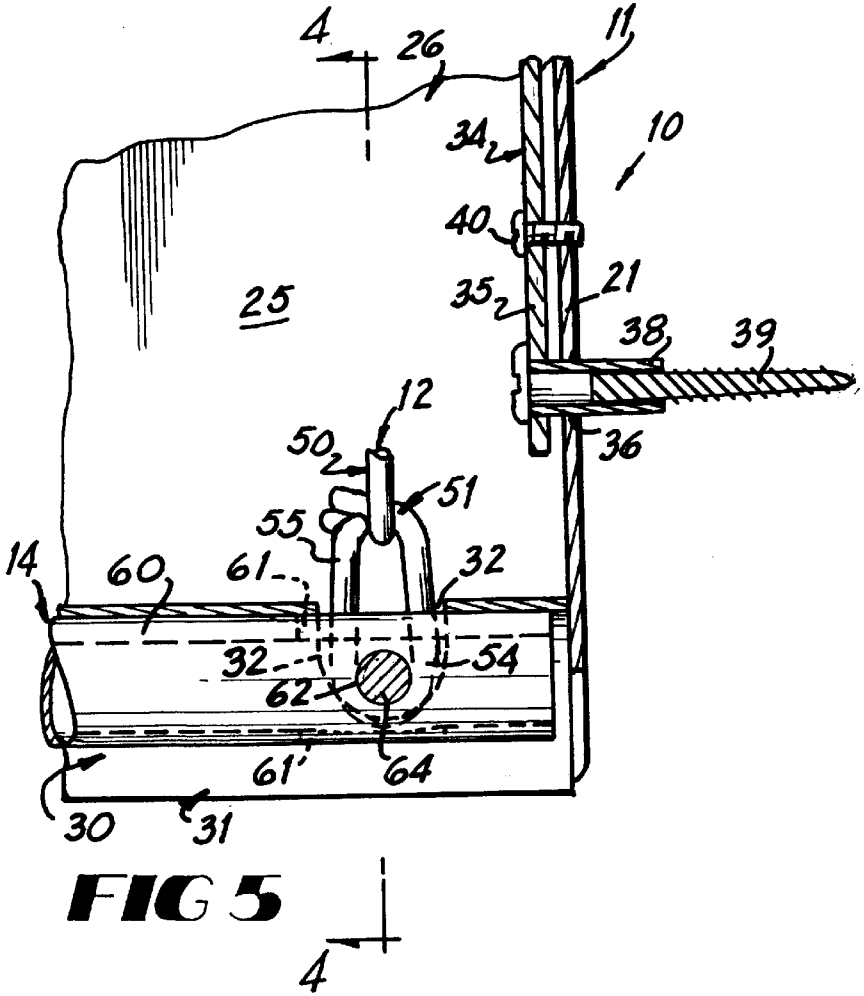

The bottom wall 22 has formed therein a longitudinally extending upstanding inverted U-shaped section 29 best seen in FIGS. 3–5 adapted to be connected to the ladder construction 12 through the connection assembly 14. The U-shaped section 29 defines a recess 30 therein with a bottom opening 31 through which the connection assembly 14 is received to attach the ladder construction 12 to the housing 11. A pair of spaced apart cutouts 32 are formed in the section 29 through which the ladder construction 12 extends into the chamber 26 as will become more apparent. The U-shaped section 29 extends substantially across the entire width of the housing so that forces from the ladder construction 12 are distributed along the length of the section 29 and transferred to the rest of the housing 11 so as to prevent high stress points that may lead to undesirable failure. The side walls 21 partly cover the ends of the recess 30 in the U-shaped section 29 as seen in FIGS. 2 and 5 to help retain the connection assembly 14 in place as will become more apparent.

A pair of adjustment mounting assemblies 34 seen in FIGS. 2, 4, and 5 are provided to connect the side walls 21 to the studs SD so that variations normally found in wall constructions can be accommodated. Each of the adjustment mounting assemblies 34includes an adjustment plate 35 having a configuration corresponding generally to a portion of the side wall 21. The side wall 21 is provided with a plurality of mounting holes 36 arranged in a prescribed pattern and a plurality of spacers 38 are mounted on the adjustment plate 35 in a pattern corresponding to that of the holes 36 in the side wall 21. All of the spacers 38 project out from the same side of the plate 35 and are oriented normal to the plane of the plate 35 so that the spacers 38 slidably project through the mounting holes 36 yet the positive connection is maintained between the side walls 21 and the mounting assembly 34. The spacers 38 are tubular so that fasteners 39 such as wood screws can be passed out through the spacers 38 from within the chamber 26 and be screwed into the studs to mount the housing 11. After the fasteners 39 are installed, locking fasteners 40 may be installed between the adjustment plate 35 and the side wall 21 to prevent movement of the housing 11 relative to the wall WL.

The housing 11 is provided with an outwardly directed front flange 41 seen in FIGS. 1–3 around the front opening 28 to the chamber 26. The front flange 41 serves to arrest the movement of the housing 11 into the wall WL and to provide a decorative finish to the opening in the wall. A front door 42 seen in FIGS. 1 and 2 is hinged to the flange 41 to selectively cover the front opening 28 to the chamber 26.

To help retain the ladder construction 12 inside the chamber 26, a flexible cover member 44 seen in FIGS. 2 and 3 is provided at the opening 28. The flexible cover member 44 has a generally rectilinear shape and is sized to partly cover the opening 28 with its lower edge 45 attached to the housing 11 along the bottom of the opening 28 and its upper edge 46 extending across the opening 28 below the top wall 24. A conventional catch mechanism 48 is provided at the upper edge 46 of the member 44 to releasably connect the member 44 with the housing 11 and retain the cover member 44 in place. The catch mechanism 48 is designed so that it is released when a force is exerted on the member 44 in order to insure that the cover member 44 will not interfere with the deployment of the ladder construction 12.

The ladder construction 12 best seen in FIGS. 2 and 3 is of conventional design with flexible ladder side members 50 illustrated as chains with interconnected links 51 and a plurality of rung members 52 that are connected between the ladder side members 50 at spaced apart positions along the lengths of the side members selected to permit the occupants to climb down the ladder construction 12 when it is deployed. Standoffs, not shown, may be provided to insure climbing clearance between the ladder construction 12 and the exterior of the structure. The near or first ends 54 of the chains 50 are connected to the connection assembly 14 as will become more apparent while the distal or second ends 56 of the chains 50 are connected by the last rung member 52.

The connection assembly 14 seen in FIGS. 3–5 includes an interconnect member 60 having a length corresponding to the width of the housing 11 and a cross-sectional size and shape so as to fit within the recess 30 in the inverted U-shaped section 29 in the bottom wall 22. The interconnect member 60 is illustrated as a tube defining a pair of chain link receiving slots 61 therethrough at spaced apart positions such that the slots 61 are in registration with the cutouts 32 in the inverted U-shaped section 29 in bottom wall 21. Cross holes 62 seen in FIGS. 4 and 5 are provided through the tube 60 in registration with the slots 61 so that the holes 62 intersect the slots 61. The end loop 55 of the first end 54 of the chains 50 are positioned in the slots 61 after the tube 60 is located in the recess 30 in the section 29 and chain fasteners 64 illustrated as bolts extend through the holes 62 to attach the chains 50 to the tube 60. The fasteners 64 also serve to retain the interconnect member 60 in position within the inverted U-shaped section 29.

With the ladder construction 12 so connected, it is collapsed and stowed in the chamber 26 in the housing 11. To facilitate the deployment of the ladder construction 12, the last rung member 52 on the distal end 56 of the chains 50 is positioned on supports 65 within the chamber 29 as best seen in FIG. 2. That way, the user simply grasps the lowermost rung and pulls the ladder construction out of the housing 11 to deploy it out of the escape opening EO. The flexible member 44 helps confine the stowed ladder construction 12 within the chamber 26 when the catch mechanisms 48 connect the upper edge of the flexible member 44 to the housing. The catch mechanisms 48 are released either by pulling out on the upper edge 46 of the member 44 or simply by grasping the last rung 52 held by the supports 65 through the opening above the flexible member 44 and pulling the chain construction 12 out to deploy it. The ladder construction 12 is passed up and out of the escape opening EO to deploy it. It will be appreciated that the weight of the person escaping will be downwardly directed to the ladder construction, however, the forces by the ladder construction 12 on the housing 11 will be upwardly directed. This insures that the forces on the housing will be distributed to the side walls 21 and evenly transmitted to the wall framework FW along the height of the side walls.

What is claimed as invention is:

1. An escape ladder and housing assembly adapted to be attached to the framework in the wall of a structure below an escape opening comprising:

a) a housing including:

a pair of upright side walls adapted to be attached to the framework in the wall of the structure below the escape opening, and a generally horizontal planar bottom wall connected to said side walls so that loads imposed on said bottom wall are transmitted to said side walls, said bottom wall defining an integral inverted U-shaped section therein extending along the length of said bottom wall and projecting upwardly therefrom, said inverted U-shaped section defining a recess thereunder closed at its upper end and opening through said bottom wall at its lower end;

b) a ladder construction including:

a pair of flexible ladder side members having first and second opposed ends, and a plurality of rung members mounted on said flexible side members at spaced apart positions so that said ladder construction has a collapsed condition for stowing and a deployed condition for use; and, c) a connection assembly mounted in said recess under said inverted U-shaped section, said connection assembly including an interconnect member having a cross-sectional size and shape conforming to that of the closed upper end of said recess under said U-shaped section and fastener means for connecting said interconnect member to said first ends of said flexible side members independently of said inverted U-shaped section, said interconnect member removably received in said recess under said inverted U-shaped section through the opening to said recess through said bottom wall whereby the forces exerted on said ladder construction, when deployed will force said interconnect member against the underside of said inverted U-shaped section to maintain said interconnect member in said recess and said interconnect member will evenly distribute forces exerted thereon by said ladder construction along the length of said inverted U-shaped section and said bottom wall.

2. The escape ladder and housing assembly of claim 1 wherein said housing further comprises a back wall extending between said housing side walls to define a ladder receiving chamber therein sized to stow said ladder construction therein in a collapsed condition, said ladder receiving chamber defining a front opening thereto opposite said back wall so that said ladder construction can be deployed therethrough, and said inverted U-shaped section located in the bottom of said ladder receiving chamber so that said ladder construction can be completely stowed within said chamber.

3. The escape ladder and housing assembly of claim 2 wherein said housing further includes a door operatively associated with said housing side walls to selectively close said front opening of said housing so as to enclose said ladder construction within said chamber when said door is closed.

4. The escape ladder and housing assembly of claim 1 wherein said inverted U-shaped section defines a pair of spaced apart cutouts therein, each of said cutouts sized to freely receive one of said first ends of said flexible ladder side members therethrough, said first ends of said flexible ladder side members of said ladder construction attached to said interconnect member and extend through said cutouts in said inverted U-shaped member so that forces exerted on said ladder construction, when deployed, force said interconnect member against said inverted U-shaped section of said bottom wall.

5. The escape ladder and housing assembly of claim 4 wherein said first ends of said flexible ladder side members of said ladder construction include a loop defining an attachment opening therethrough, wherein said interconnect member defines a pair of spaced apart loop receiving slots therethrough located so as to be in registration with said cutouts in said inverted U-shaped section when said interconnect member is located within said inverted U-shaped section of said bottom wall, each of said loop receiving slots sized to movably receive one of said loops on said ladder construction therein, wherein said interconnect member further defines a pair of cross holes therethrough, each of said cross holes oriented normal to and in registration with one of said loop receiving slots, and wherein one of said loops on said ladder construction extends through each of said cutouts in said inverted U-shaped member and into said loop receiving slot in said interconnect member in registration with said cutout so that said attachment opening in said loop is in registration with said cross hole in said interconnect member, and wherein said connection assembly further comprises fastener means extending through each of said cross holes in said interconnect member and said attachment opening through said loop in registration with said cross hole to attach said loops in said first ends of said flexible side members of said ladder construction to said interconnect member independently of said inverted U-shaped section, said fastener means serving to retain said interconnect member within said inverted U-shaped member.

6. The escape ladder and housing assembly of claim 1 adapted to be mounted within the wall between a pair of spaced apart vertically extending studs of the wall framework using mounting fasteners and further including at least one adjustment mounting assembly associated with one of said housing side walls for mounting said housing side wall to one of the vertical studs of the framework, said adjustment mounting assembly movably mounting said associated housing side wall thereon for movement of said side wall relative to said mounting assembly normal to said housing side wall while preventing movement of said housing side wall relative to said mounting assembly in directions parallel to said side wall, said adjustment mounting assembly constructed and arranged to be fixedly attached to one of said vertical studs of the framework with the fasteners independently of said side wall mounted on said adjustment mounting assembly while said housing is located within said wall so that said side wall mounted on said adjustment mounting assembly can be located at different distances from the vertical stud mounting said adjustment mounting assembly for accommodating different spacing between the vertical studs of the framework within the wall of the structure while positively mounting said housing on said framework.

7. The escape ladder and housing assembly of claim 6 wherein said side wall associated with said adjustment mounting assembly defines a plurality of mounting holes therethrough at prescribed spaced apart locations thereon and wherein said adjustment mounting assembly comprises an adjustment plate located within said chamber in said housing and a plurality of elongate adjustment spacers fixedly mounted on said adjustment plate and projecting outwardly from one side of said adjustment plate at locations corresponding to the locations of said mounting holes in said side wall, each of said adjustment spacers defining a projecting end thereon, said adjustment spacers slidably passing through said mounting holes in said side wall associated with said adjustment plate so that the projecting ends of said adjustment spacers can move toward and away from said side wall, each of said adjustment spacers defining a fastener receiving hole therethrough, said mounting fasteners extending through said adjustment spacers and into one of the studs in the wall framework to fixedly attach said adjustment mounting assembly to the framework with the projecting ends of said adjustment spacers abutting the stud in the wall framework so that said housing is positively attached to said wall framework even though the spacing between the studs in the wall framework may be different than the distance between said housing side walls.

8. The escape ladder and housing assembly of claim 7 further including locking fastener means for attaching said adjustment plate of said adjustment mounting assembly to said housing wall associated therewith after said adjustment mounting assembly is attached to the wall stud so as to prevent relative movement between said housing side wall and said adjustment mounting assembly normal to said side wall to prevent movement of said housing relative to the wall framework.

9. An escape ladder and housing assembly adapted to be attached to the framework in the wall of a structure below an escape opening comprising:

a) a ladder construction including:
- a pair of flexible ladder side members having first and second opposed ends, and
- a plurality of rung members mounted on said flexible side members at spaced apart positions so that said ladder construction has a collapsed condition for stowing and a deployed condition for use;

b) a housing including:
- a pair of upright side walls adapted to be attached to the framework in the wall of the structure below the escape opening,
- a generally horizontal bottom wall connected to said side walls so that loads imposed on said bottom wall are transmitted to said side walls, said bottom wall including an inverted U-shaped section therein,
- a back wall extending between said housing side walls to define a ladder receiving chamber therein sized to stow said ladder construction therein in a collapsed condition, said ladder receiving chamber defining a front opening thereto opposite said back wall so that said ladder construction can be deployed therethrough, and said inverted U-shaped section located in the bottom of said ladder receiving chamber so that said ladder construction can be completely stowed within said chamber,
- a door operatively associated with said housing side walls to selectively close said front opening of said housing so as to enclose said ladder construction within said chamber when said door is closed, and
- a flexible cover member extending between said side walls to hold said ladder construction in place within said chamber, said flexible member including a lower edge mounted between said side walls adjacent said bottom wall and an opposed upper edge; and releasable catch means for releasably interconnecting said upper edge of said flexible member to said housing to selectively retain said ladder construction within said chamber in a stowed condition; and c) a connection assembly mounted in said inverted U-shaped section of said bottom wall and connected to said first ends of said flexible side members to connect said ladder construction to said housing so that, when said ladder construction is deployed through the escape opening, loads on the ladder are transmitted to said housing and the wall framework through said inverted U-shaped section in said bottom wall.

10. The escape ladder and housing assembly of claim 9 wherein said connection assembly further comprises an interconnect member having a cross-sectional size and shape to fit within said inverted U-shaped section in said bottom wall, and wherein said inverted U-shaped section defines a pair of spaced apart cutouts therein, said first ends of said flexible ladder side members of said ladder construction attached to said interconnect member and extending through said cutouts in said inverted U-shaped member so that forces exerted on said ladder construction, when deployed, force said interconnect member against said inverted U-shaped section of said bottom wall.

11. The escape ladder and housing assembly of claim 10 wherein said first ends of said flexible ladder side members of said ladder construction include a loop defining an attachment opening therethrough, wherein said interconnect member defines a pair of spaced apart loop receiving slots therethrough located so as to be in registration with said cutouts in said inverted U-shaped section when said interconnect member is located within said inverted U-shaped section of said bottom wall, each of said loops on said flexible ladder side members extending into one of said loop receiving slots through said interconnect member, and wherein said connection assembly further comprises fastener means attaching said loops in said slots to said interconnect member.

12. The escape ladder and housing assembly of claim 9 wherein said housing further includes adjustment mounting means for selectively adjusting the effective width of said housing to accommodate different spacing within the framework within the wall of the structure to mount said housing on said framework.

13. The escape ladder and housing assembly of claim 12 wherein said adjustment mounting means comprises a plurality of mounting holes through each of said side walls of said housing; a pair of adjustment plates, one associated with each of said side walls; a plurality of elongate adjustment spacers fixedly mounted on each of said adjustment plates and projecting outwardly from one side of said adjustment plate at locations corresponding to the locations of said mounting holes in said side walls, each of said adjustment spacers defining a projecting end thereon, each of said adjustment plates located within said chamber in said housing with said adjustment spacers slidably passing through said mounting holes in said side wall associated with said adjustment plate so that the projecting ends of said adjustment spacers can move toward and away from said side wall, each of said adjustment spacers defining a fastener receiving hole therethrough; and a plurality of mounting fasteners adapted to extend through said adjustment spacers and into said wall framework to fixedly attach each of said adjustment plates and said adjustment spacers mounted thereon to said framework with the projecting ends of said adjustment spacers abutting said wall framework so that said housing is positively attached to said wall framework even though the spacing between the wall framework may be different than the distance between said housing side walls.

14. An escape ladder and housing assembly adapted to be attached between a pair of spaced apart wall studs within the wall of a structure below an escape opening using mounting fasteners comprising:

a housing defining a ladder receiving chamber therein and including a pair of parallel upright side walls located a prescribed distance apart, one of said side walls defining a plurality of mounting holes therethrough at prescribed spaced apart locations thereon;

a collapsible ladder construction mounted in the ladder receiving chamber in said housing so that the ladder construction can be stowed in said housing in a collapsed condition and deployed from said housing for use; and an adjustment mounting assembly movably mounting said one of said housing side walls thereon for movement of said housing side wall relative to said mounting assembly in a direction normal to said housing side wall while preventing movement of said housing side wall relative to said mounting assembly in directions parallel to said side wall, said adjustment mounting assembly comprising an adjustment plate located within said chamber in said housing and a plurality of elongate adjustment spacers fixedly mounted on said adjustment plate and projecting outwardly from one side of said adjustment plate at locations corresponding to the locations of said mounting holes in said one of said side walls, each of said adjustment spacers defining a projecting end thereon, said adjustment spacers slidably passing through said mounting holes in said side wall associated with said adjustment plate so that the projecting ends of said adjustment spacers can move toward and away from said side wall, each of said adjustment spacers defining a fastener receiving hole therethrough adapted to receive one of said mounting fasteners therethrough, said adjustment mounting assembly adapted to be fixedly attached to one of said vertical studs of the framework with said mounting fasteners extending through said adjustment spacers and into the vertical stud so that the projecting ends of said adjustment spacers abut the stud in the wall framework while said housing is located within said wall so that said adjustment mounting assembly is fixedly located relative to the vertical stud and said housing side wall mounted on said adjustment mounting assembly can be moved relative to said adjustment mounting assembly to locate said housing side wall at different distances from the vertical stud mounting said adjustment mounting assembly for accommodating spacings between the vertical studs of the framework within the wall of the structure greater than the distance between said housing side walls while positively mounting said housing on said framework.

15. The escape ladder and housing assembly of claim 14 wherein said adjustment mounting assembly further comprises locking fastener means adapted to connect said adjustment plate and said side wall mounted on said adjustment spacers and selectively fix the relative position of said housing side wall relative to said adjustment plate.

* * * * *